US008677984B2

(12) United States Patent
Boyd et al.

(10) Patent No.: US 8,677,984 B2
(45) Date of Patent: Mar. 25, 2014

(54) METHOD AND APPARATUS FOR TILE CUTTING

(76) Inventors: Adam Boyd, Royal Oak, MI (US); Benjamin Frank, Waterford, MI (US)

( * ) Notice: Subject to any disclaimer, the term of this patent is extended or adjusted under 35 U.S.C. 154(b) by 77 days.

(21) Appl. No.: 13/269,600

(22) Filed: Oct. 9, 2011

(65) Prior Publication Data

US 2013/0174827 A1 Jul. 11, 2013

Related U.S. Application Data

(60) Provisional application No. 61/393,774, filed on Oct. 15, 2010.

(51) Int. Cl.
*B28D 1/04* (2006.01)

(52) U.S. Cl.
USPC ..... 125/13.01; 125/12; 125/35

(58) Field of Classification Search
USPC ..... 125/13.01, 12, 35; 269/43, 299, 291; 451/58, 57, 65, 69
See application file for complete search history.

(56) References Cited

U.S. PATENT DOCUMENTS

| | | | | | |
|---|---|---|---|---|---|
| 2,911,773 | A * | 11/1959 | Gobat | 451/41 |
| 3,089,478 | A * | 5/1963 | Jones | 125/35 |
| 3,168,893 | A * | 2/1965 | Johnson | 125/13.01 |
| 3,463,137 | A * | 8/1969 | Hare | 125/35 |
| 4,061,126 | A | 12/1977 | Schlangen | |
| 4,315,494 | A * | 2/1982 | DiPlacido | 125/35 |
| 4,428,159 | A * | 1/1984 | Sigetich et al. | 451/213 |
| 4,924,843 | A * | 5/1990 | Waren | 125/35 |
| 5,437,103 | A * | 8/1995 | Baptiste | 30/372 |
| 5,482,026 | A * | 1/1996 | Russell | 125/12 |
| 5,676,124 | A * | 10/1997 | Lee | 125/13.01 |
| 5,832,913 | A | 11/1998 | Arends | |
| 6,068,547 | A * | 5/2000 | Lupi | 451/388 |
| 6,152,127 | A | 11/2000 | Fuhrman | |
| 6,155,245 | A * | 12/2000 | Zanzuri | 125/12 |
| 6,508,244 | B2 | 1/2003 | Lee | |
| 6,782,882 | B1 | 8/2004 | Chen | |
| 7,946,906 | B2 * | 5/2011 | Gifford et al. | 451/8 |
| 2005/0155593 | A1 * | 7/2005 | Takemura et al. | 125/13.01 |

* cited by examiner

*Primary Examiner* — George Nguyen

(74) *Attorney, Agent, or Firm* — Young Basile Hanlon & MacFarlane P.C.

(57) ABSTRACT

A method and apparatus for cutting rigid, brittle articles such as tile used as a building material is improved by the capability to make both straight and curved cuts in tile on a single machine. The machine has both circular and plunge cutting tools and a table for moving the tile in both curved and straight lines in relation to the cutting tool, thereby achieving both curved and straight cuts.

2 Claims, 4 Drawing Sheets

METHOD AND APPARATUS FOR TILE CUTTING

CROSS-REFERENCE TO RELATED APPLICATION

This application claims the benefit of U.S. Provisional Application No. 61/393,774, filed 15 Oct. 2010.

TECHNICAL FIELD

This invention is an improved method and apparatus for cutting rigid, brittle articles such as tile used as a building material, the improvements including having the capability to make both straight and curved cuts in tile on a single machine. The machine has both circular and plunge cutting tools and a table for moving the tile in both curved and straight lines in relation to the cutting tool, thereby achieving both curved and straight cuts.

BACKGROUND

Ceramic tile is an example of a planar, rigid, brittle material used as a functional and decorative building material. Other types of generally planar rigid, brittle articles used as building materials include glass and glass-like materials, granite and artificial rock-like materials, and other materials such as concrete or other settable materials. These materials are generally manufactured as sheets or evenly sized squares or shapes that can be applied to a prepared structure to create a hard, decorative surface such as a floor or counter. An issue which applies to all such materials is a need to cut the shape or sheet to fit a particular area or shape on the prepared structure.

The need to fixture tile for cutting with a power saw has been recognized. U.S. Pat. No. 6,508,244 B2, issued Jan. 21, 2003 to inventor Wy Peron Lee, discloses a table with guides for holding tile to be cut with straight cuts. U.S. Pat. No. 5,832,913, issued on Nov. 10, 1998 to inventor William R. Arends, discloses an improved table for cutting tile that permits tiles to be cut along straight lines at angles which may not be parallel to one of the sides of the tile. Neither of these discloses a means for cutting tile with curved cuts. U.S. Pat. No. 4,061,126, issued on Dec. 6, 1977 to inventor Ronald F. Schlangen, discloses a band saw arrangement for sawing tile with a circular silicon carbide blade. While this arrangement is capable of making curved cuts, the size and shape of the cut is determined by freehand control of the article on the saw. Likewise, U.S. Pat. No. 6,152,127, issued on Nov. 28, 2000 to inventors Michael D. Fuhrman and Dana E. Fuhrman, discloses a router attached to a table with linear motion capable of making straight cuts or freehand curves.

SUMMARY

What none of the patents cited above disclose is a means for fixturing a tile or other brittle, rigid, planar building material in a machine that will permit a power saw to cut both straight lines or curves with a specified radius. What is needed then is a machine that permits tile to be cut in both straight lines and curves of specified radius with a single power saw on a single table.

Aspects of this invention improve making straight cuts, curved cuts with specified radius and freehand curves in articles such as building tile with a power saw. The power saw has a table and a saw, with the saw operative to use both circular blades and plunge cutters. The table is provided with both linear and rotary stages, arranged so that a workpiece such as building tile can be moved in both a linear and rotary fashion with respect to the saw blades. The saw is fitted with a rotatable bearing to hold a circular blade perpendicular to the workpiece. By then moving the workpiece with the linear stage, a straight cut is achieved. When a plunge cutter is fitted to the saw, the rotatable bearing is rotated to hold the plunge cutter perpendicular to the workpiece. By moving the workpiece with the rotary stage, a curved cut is achieved.

Aspects of this invention accomplish compound motion necessary for cutting complex shapes in building materials by combining a linear stage with a rotary stage to hold the workpiece. The rotary stage is mounted on the linear stage by a rotary stage bearing. Either of the stages may be locked to prevent it from moving if purely linear or rotary motion is desired. These stages move a workpiece in relation to an electric saw which is positioned with respect to the table and stages radially on an arm that also pivots. The power saw is connected to a saw bearing that pivots on an axis perpendicular to the axis of rotation of the saw to permit the use of both circular and plunge type blades. The saw bearing is connected to an arm bearing that moves radially along the arm. The entire power saw assembly including the saw, the saw bearing, the arm bearing and the arm is moved up and down and rotated by the arm lift/bearing to move the blades up and down in relation to the surface of the workpiece. The arm lift/bearing, the arm bearing and the motor bearing may be adjusted or positioned manually or with assistance such as gearing, hydraulics or motors. These bearings are fitted with appropriate locks or other ways of preventing movement when desired and appropriate markings, scales, detents or other methods of aligning the various parts.

In operation, aspects of this invention perform straight cuts in brittle building materials by fitting a circular blade to the power saw and rotating the saw bearing to make the circular blade parallel to the direction of travel of the linear stage and then positioning the circular blade laterally and vertically with respect to the workpiece. The rotary stage is locked and the workpiece is then moved into the circular saw blade with the linear stage to achieve a straight cut. Curved cuts are performed by first fitting the saw with a plunge type blade. The saw is rotated on the saw bearing to make the plunge type blade perpendicular to the surface of the workpiece. The blade is positioned in cooperation with the linear stage to place the blade in relation to the center of rotation of the rotary stage and the linear stage locked. This permits cutting arcs of arbitrary radius. The workpiece is then positioned on the rotary stage and the plunge type blade is lowered by the arm lift/bearing into the brittle material, cutting an arc as the workpiece is rotated under the blade by rotating the rotary stage. In a like manner, freehand shapes may be cut in brittle materials with a plunge type blade by moving both the rotary and linear stages simultaneously.

DETAILED DESCRIPTION

Figure 1:
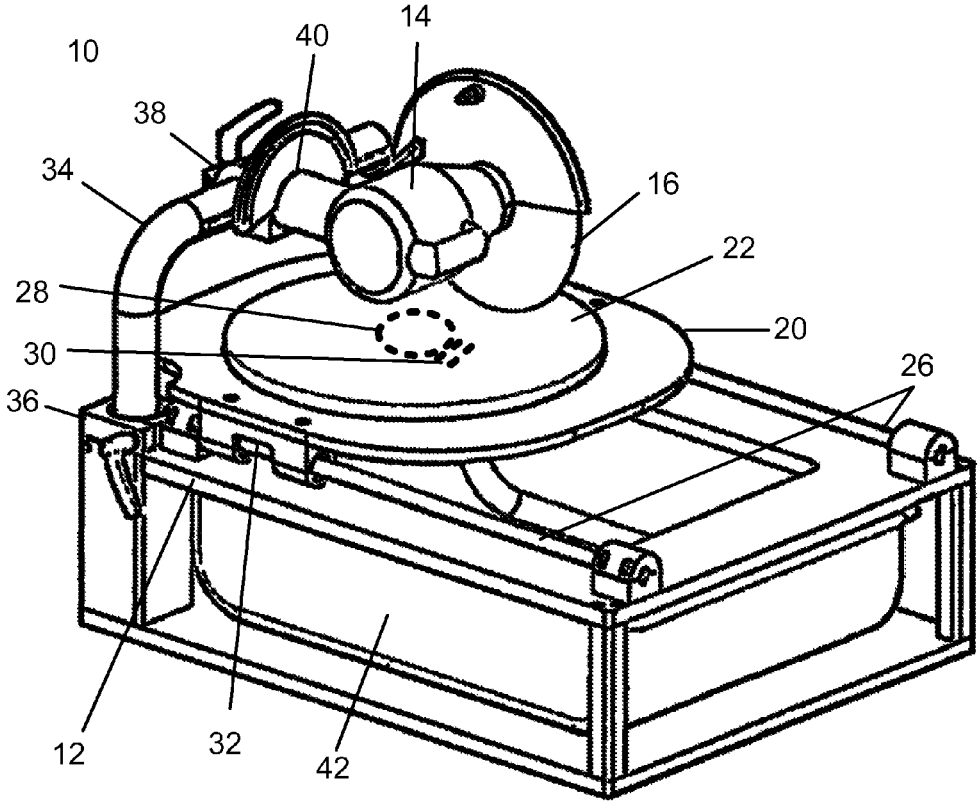
FIG. 1 is a perspective view of a tile cutting device.

Embodiments of this invention are an improved method for cutting both straight cuts and curved cuts with specified radius in brittle building materials with a power saw. FIG. 1 shows a power saw 10 having a table 12 and a saw 14, with the saw operative to use both circular blades 16 and plunge cutters 18 (see FIG. 3). The table 12 is provided with both linear 20 and rotary 22 stages, arranged so that a workpiece such as a building tile 50 can be moved in either a linear or rotary fashion with respect to the saw blade 16. The saw 14 is held in place by a rotatable bearing 40 to position a circular blade 16 perpendicular to the workpiece and parallel to the direction of travel of the linear stage 20. By then moving the workpiece 50 to intersect the circular blade 16 with the linear stage 20, straight cuts are performed. When fitting the saw with a plunge cutter 18, the rotatable bearing 40 is rotated to hold the plunge cutter 18 perpendicularly to said workpiece. Then, moving the workpiece with the rotary stage 22 achieves a curved cut.

Aspects of this invention achieve compound motion necessary for cutting complex shapes 28, 30 in building materials by combining a linear stage 20 with a rotary stage 22 that holds the workpiece. The rotary stage 22 is mounted on the linear stage 20 by a rotary stage bearing 32. Either of the stages 20, 22 may be locked to prevent it from moving if purely linear or rotary motion is desired. These stages 20, 22 move a workpiece in relation to a power saw 14 which is positioned with respect to the frame 12 and stages 20, 22 radially on an arm 34 that also pivots. The power saw 14 is connected to a saw bearing 40 that pivots on an axis perpendicular to the axis of rotation of the saw to permit the use of both circular and plunge type blades 16, 18. The saw bearing 40 is connected to an arm bearing 38 that moves radially along the arm 34. The entire power saw assembly including the saw 14, the saw bearing 40, the arm bearing 38 and the arm 34 is moved up and down and rotated by the arm lift/bearing 36 to move the blades 16, 18 up and down in relation to the surface of the workpiece. The arm lift/bearing 36, the arm bearing 38 and the motor bearing 40 may be adjusted or positioned manually or with assistance such as gearing, hydraulics or motors. These bearings 36, 38, 40 are fitted with appropriate locks or other ways of preventing movement when desired and appropriate markings, scales, detents or other methods of aligning the various parts.

Figure 2:
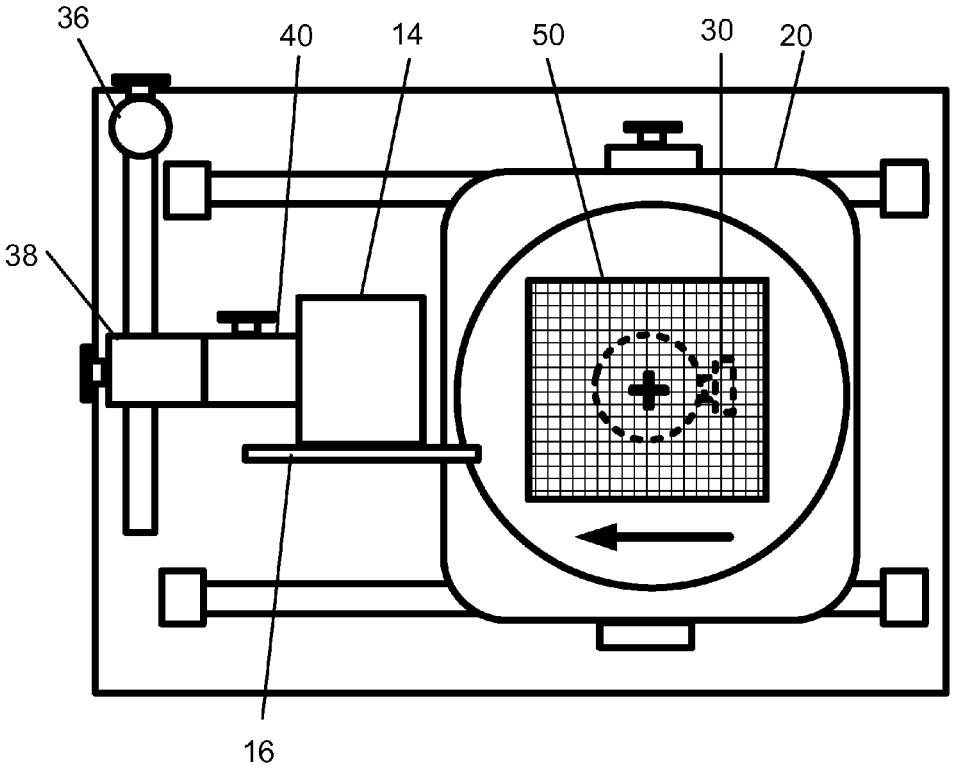
FIG. 2 is a plan view of the tile cutting device of FIG. 1 set for a straight cut.
Figure 4A:
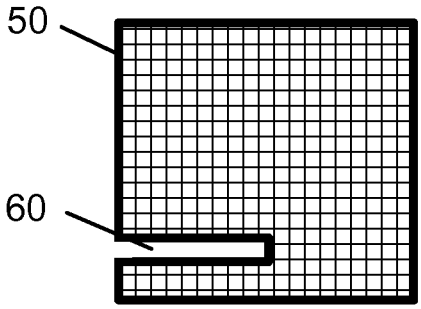
FIG. 4*a* is a plan view of a tile with straight cut.

Aspects of this invention perform straight cuts in brittle building materials by fitting a circular blade 16 to the power saw 14 and rotating the saw bearing 40 to make the circular blade 16 parallel to the direction of travel of the linear stage 20 along rails 26 and then positioning the circular blade 16 laterally and vertically with respect to the workpiece 50. The rotary stage 22 is locked and the workpiece 50 is then moved into the circular saw blade 16 with the linear stage 20 to achieve a straight cut. FIG. 2 is a plan view of the tile cutting device 10 of FIG. 1 set for a straight cut. FIG. 4*a* is a plan view of the workpiece, tile 50, with straight cut 60.

Figure 3:
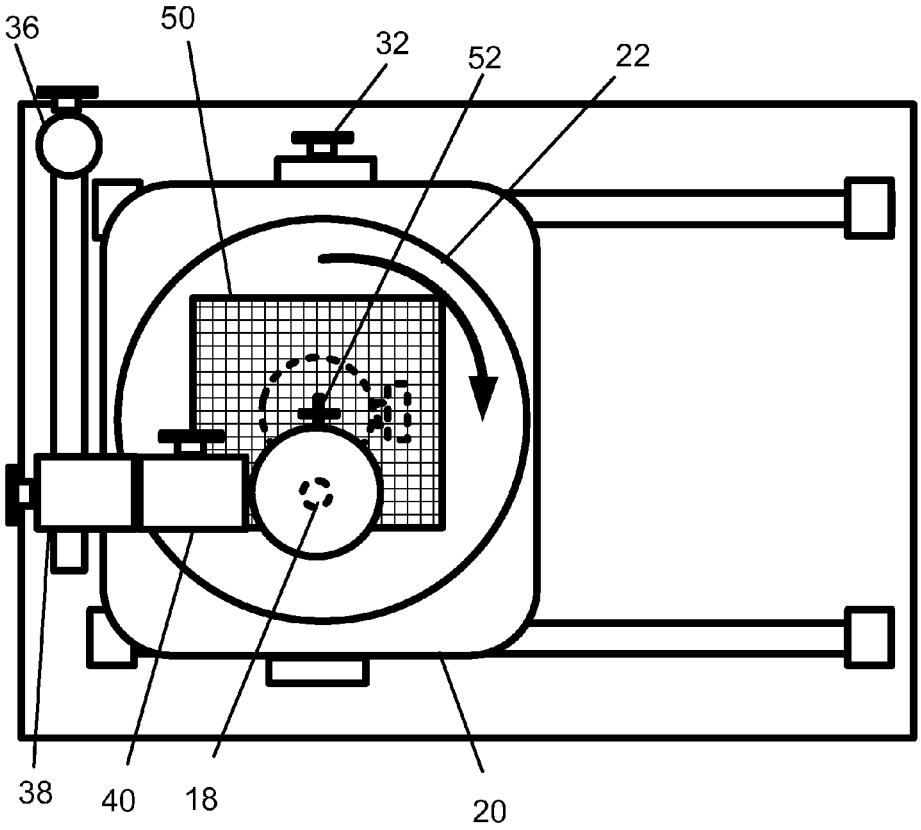
FIG. 3 is a plan view of the tile cutting device of FIG. 1 set for an arcuate cut.
Figure 4B:
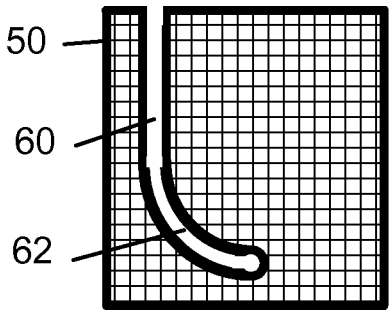
FIG. 4*b* is a plan view of a tile with curved cut.

Arcuate cuts are performed by first fitting the power saw with a plunge type blade 18. The power saw 14 is rotated on the saw bearing 40 to make the plunge type blade 18 perpendicular to the surface 28, 30 of the workpiece. The blade 18 is positioned in cooperation with the linear stage 20 to place the blade 18 in relation to the center 52 of rotation of the rotary stage 22 and the linear stage 20 locked. This permits cutting arcs of arbitrary radius. The workpiece is then positioned on the rotary stage and the plunge type blade is lowered by the arm lift/bearing 36 into the brittle material, cutting an arc as the workpiece is rotated under the blade 18 by rotating the rotary stage 22. In like manner, freehand shapes may be cut in brittle materials with a plunge type blade 18 by moving both the rotary 22 and linear 20 stages simultaneously. FIG. 3 is a plan view of the tile cutting device 10 of FIG. 1 set for an arcuate cut. FIG. 4*b* is a plan view of the tile 50 of FIG. 4*a* with a curved cut 62.

We claim:

1. In a method for cutting articles with a power saw; said power saw having a table and a saw, the improvement comprising;

providing said table with both linear and rotary stages;

providing said saw with a rotatable holder;

fitting said saw with a circular blade;

rotating said rotatable holder to position said circular blade perpendicular to said article and parallel to said linear stage;

moving said article with said linear stage thereby intersecting said article with said circular blade and making a straight cut;

fitting said saw with a plunge cutter;

rotating said rotatable holder to position said plunge cutter perpendicular to a rotation direction of said rotary stage and intersecting said article; and moving said article with said rotary stage and intersecting said article with said plunge cutter and making a curved cut.

2. In an apparatus for cutting articles with a power saw; said power saw having a table and a saw, the improvement comprising;

a linear stage with a rotary stage attached so that said article placed upon said rotary stage can be moved linearly or rotatably or both under said saw;

a rotatable saw holder that permits said saw to position a circular saw blade fitted to said saw in a direction parallel to the direction of the linear stage and to position a plunge cutter fitted to said saw perpendicularly to a rotation direction of the rotary stage.

* * * * *